US011397060B2

(12) United States Patent
Bauchart et al.

(10) Patent No.: US 11,397,060 B2
(45) Date of Patent: Jul. 26, 2022

(54) HEAT EXCHANGER PANEL AND METHOD FOR MOUNTING THEREOF TO A RACK STRUCTURE

(71) Applicant: OVH, Roubaix (FR)

(72) Inventors: Gregory Francis Louis Bauchart, Wattrelos (FR); Ali Chehade, Templeuve (FR); Henryk Klaba, Roubaix (FR)

(73) Assignee: OVH, Roubaix (FR)

( * ) Notice: Subject to any disclaimer, the term of this patent is extended or adjusted under 35 U.S.C. 154(b) by 0 days.

(21) Appl. No.: 16/988,195

(22) Filed: Aug. 7, 2020

(65) Prior Publication Data

US 2021/0063095 A1 Mar. 4, 2021

(30) Foreign Application Priority Data

Aug. 30, 2019 (EP) ..... 19315108

(51) Int. Cl.
*F28F 3/08* (2006.01)
*F28F 1/40* (2006.01)
(Continued)

(52) U.S. Cl.
CPC ..... *F28F 3/083* (2013.01); *F28F 1/40* (2013.01); *F28F 9/002* (2013.01); *F28F 9/0075* (2013.01);
(Continued)

(58) Field of Classification Search
CPC .. F28F 1/40; F28F 9/002; F28F 9/0075; F28F 2280/10; F28F 3/083
See application file for complete search history.

(56) References Cited

U.S. PATENT DOCUMENTS 1,485,601 A * 3/1924 Dillon ..... F28D 21/0007 165/78
1,654,190 A * 12/1927 Primrose ..... F28B 1/06 165/103
(Continued)

FOREIGN PATENT DOCUMENTS

CA 2809418 A1 9/2014
EP 1239255 A2 9/2002
(Continued)

OTHER PUBLICATIONS

European Search Report with regard to the counterpad European Patent Application No. 19315108.1 completed Mar. 12, 2020.
(Continued)

*Primary Examiner* — Paul Alvare
(74) *Attorney, Agent, or Firm* — BCF LLP

(57) ABSTRACT

A heat exchanger stack includes a rack structure and heat exchangers disposed above one another and supported thereby. Each heat exchanger includes: a frame; a tubing arrangement configured to circulate fluid therein; a plurality of fins; and a plurality of wheels mounted to the frame for guided mounting of the heat exchanger panel on the rack structure including first and second upper wheels spaced apart from one another and first and second lower wheels spaced apart from one another. Each upper wheel engages a corresponding upper wheel guiding member of the rack structure, and each lower wheel engages a horizontal portion of a corresponding lower wheel guiding member of the rack structure so that the heat exchanger panel is translatable horizontally. A method for mounting a heat exchanger panel to a rack structure is also provided.

15 Claims, 15 Drawing Sheets

(51) Int. Cl.
*F28F 9/007* (2006.01)
*F28F 9/00* (2006.01)

(52) U.S. Cl.
CPC ..... *F28F 2280/02* (2013.01); *F28F 2280/10* (2013.01)

(56) References Cited

U.S. PATENT DOCUMENTS 1,787,444 A * 1/1931 French ..... F28D 7/06 165/72
3,078,080 A * 2/1963 Slough ..... E04H 5/12 261/109
3,223,152 A * 12/1965 Franzschulenberg ..... F28B 1/06 165/146
4,199,857 A * 4/1980 Meuschke ..... G21F 9/28 29/426.3
4,499,942 A * 2/1985 Allison ..... F28F 3/083 165/166
4,926,931 A * 5/1990 Larinoff ..... F28B 1/06 165/111
5,121,613 A * 6/1992 Cox ..... F24F 1/0087 62/419
5,207,074 A * 5/1993 Cox ..... F24F 13/30 62/285
6,378,605 B1 * 4/2002 Kutscher ..... F28B 1/06 165/181
9,335,098 B2 * 5/2016 Pawlick ..... F28D 1/024
9,616,530 B2 4/2017 Kondou et al.
9,850,655 B2 12/2017 Matoric et al.
2006/0005943 A1 1/2006 Rasset et al.
2009/0194352 A1 8/2009 Plante et al.
2016/0146550 A1 * 5/2016 Martin ..... F01N 1/00 165/67
2017/0363357 A1 * 12/2017 Bugler ..... F28B 1/06

FOREIGN PATENT DOCUMENTS

EP 1239255 A3 1/2005
GB 2332507 A 6/1999
KR 101693147 B1 1/2017

OTHER PUBLICATIONS

English Translation of KR101693147 retrieved on Espacenet on Jun. 20, 2019.
English Abstract of EP 1239255 retrieved on Espacenet on Aug. 6, 2020.

* cited by examiner

HEAT EXCHANGER PANEL AND METHOD FOR MOUNTING THEREOF TO A RACK STRUCTURE

CROSS-REFERENCE

The present application claims priority from European Patent Application No. 19315108.1, filed on Aug. 30, 2019, the entirety of which is incorporated herein by reference.

FIELD OF TECHNOLOGY

The present technology relates generally to heat exchanger stacks as well as to methods for mounting heat exchanger panels to a rack structure.

BACKGROUND

Buildings are often equipped with heat management systems to regulate heat within the building. In certain types of buildings, heat management may be a particularly crucial consideration due to the intended use of the building. For instance, data centers, which store an extensive amount of heat-generating electronic equipment, typically implement a sizable heat management system to evacuate heat from the data center.

For example, data centers are often equipped with dry coolers installed on the roof of the building that houses the data center. Heated fluid (e.g., heated water) extracted from the data center (e.g., collected at the server level) is circulated to the dry coolers where the fluid transfers its heat into the ambient air pulled into the dry coolers. The heated air is then discharged into the ambient air and the now cooled fluid is recirculated back into the data center and the process is repeated.

It has been proposed to build a dry cooler tower including vertical dry cooler stacks, whereby various dry coolers are stacked vertically one on top of the other such that their respective fan assemblies are oriented to discharge heated air horizontally instead of vertically as is more typical. This has been shown to minimize recycling of heated air by adjacent dry coolers as the heated air is discharged into a common zone that is surrounded by the dry cooler stacks. However, such dry cooler towers can be difficult to assemble, as a rack structure has to be provided and the different components of each dry cooler separately mounted thereto, including the heat exchanger panels of the dry coolers which are typically heavy (e.g., 300-400 kg) and therefore require heaving machinery to manipulate. In addition, as the heat exchanger panels are of a considerable size, installing the heat exchanger panels onto (or dismounting the heat exchanger panels from) the rack structure usually requires a significant amount of space to be kept clear on the side of the rack structure from which it is intended to install/remove the heat exchanger panels. Thus, while the dry cooler stacks may not be too big in size, they may still have a significant footprint in the environment in which they are installed as additional space has to be kept clear to allow the installation or removal of the heat exchanger panels.

Thus there is a desire for a heat exchanger stack and a method for mounting a heat exchanger panel to a rack structure that alleviates at least in part some of these drawbacks.

SUMMARY

It is an object of the present technology to ameliorate at least some of the inconveniences present in the prior art.

According to one aspect of the present technology, there is provided a heat exchanger stack. The heat exchanger stack includes a rack structure and a plurality of heat exchangers supported by the rack structure. The rack structure includes: a plurality of vertical legs; a plurality of laterally-extending horizontal members extending between and interconnecting laterally-adjacent ones of the vertical legs; a plurality of longitudinally-extending horizontal members extending between and interconnecting longitudinally-adjacent ones of the vertical legs; a plurality of lower wheel guiding members, each lower wheel guiding member having a horizontal portion extending horizontally and an angled portion that is angled relative to the horizontal portion; and a plurality of upper wheel guiding members vertically spaced from the lower wheel guiding members, each of the upper wheel guiding members extending at least partly horizontally. The heat exchangers are disposed above one another. Each heat exchanger includes a fan assembly mounted to the rack structure and a heat exchanger panel mounted to the rack structure. The fan assembly includes a fan impeller rotatable about a fan rotation axis extending horizontally. The heat exchanger panel includes: a frame having an upper end and a lower end opposite the upper end; a tubing arrangement supported by the frame and configured to circulate fluid therein, the tubing arrangement having an inlet and an outlet; a plurality of fins in thermal contact with the tubing arrangement, the fins being spaced apart from one another for air to flow therebetween and through the heat exchanger panel; and a plurality of wheels mounted to the frame. Each of the wheels is rotatable about a respective axis extending generally laterally. The wheels are configured to engage respective ones of the lower and upper wheel guiding members of the rack structure for guided mounting of the heat exchanger panel on the rack structure. The wheels include: an upper set of wheels mounted to the upper end of the frame, the upper set of wheels including a first upper wheel and a second upper wheel spaced apart from one another; and a lower set of wheels mounted to the lower end of the frame, the lower set of wheels including a first lower wheel and a second lower wheel spaced apart from one another. Each upper wheel engages a corresponding upper wheel guiding member and each lower wheel engages the horizontal portion of a corresponding lower wheel guiding member so that the heat exchanger panel is translatable horizontally.

In some embodiments, the first upper wheel and the second upper wheel are spaced apart from one another by a first distance, and the first lower wheel and the second lower wheel are spaced apart from one another by a second distance. The first distance is different from the second distance.

In some embodiments, the first distance is greater than the second distance.

In some embodiments, a ratio of the first distance over the second distance is between 1.1 and 1.5.

In some embodiments, for each heat exchanger panel: the frame has a first lateral end and a second lateral end; the first and second upper wheels are spaced laterally outwardly from the first and second lateral ends of the frame; and the first and second lower wheels are disposed laterally inwardly from the first and second lateral ends of the frame.

In some embodiments, for each heat exchanger panel, the frame includes: an upper frame member defining the upper end of the frame, the upper frame member defining a channel extending laterally, and a lower frame member defining the lower end of the frame, the lower frame member defining a channel extending laterally. For each heat exchanger panel, the heat exchanger panel also includes a plurality of wheel mounts for mounting at least one of the wheels to the frame. Each of the wheel mounts includes: an elongated rail inserted within the channel defined by one of the upper and lower frame members, the elongated rail being removably connected to the one of the upper and lower frame members; and at least one mounting bracket interconnecting one of the at least one of the wheels to the elongated rail.

In some embodiments, the elongated rail is connected to the one of the upper and lower frame members by a plurality of fasteners extending from a front face to a rear face of the one of the upper and lower frame members.

In some embodiments, each of the at least one mounting bracket has a first portion extending parallel to the elongated rail and a second portion extending perpendicularly to the first portion, the one of the at least one of the wheels being connected to the second portion.

In some embodiments, at least one of the wheel mounts includes at least one lifting bracket; each of the at least one lifting bracket is connected to a corresponding one of the at least mounting bracket; and each of the at least one lifting bracket defines an opening for connecting a lifting device to the heat exchanger panel and lift the heat exchanger panel therefrom.

According to another aspect of the present technology, there is provided a method for mounting a heat exchanger panel to a rack structure. The method includes: lifting the heat exchanger panel via lifting brackets connected to a frame of the heat exchanger panel; lowering the heat exchanger panel until lower wheels mounted to a lower end of the frame of the heat exchanger panel are received and supported by respective lower wheel guiding members of the rack structure; rolling the heat exchanger panel downwardly by engagement of the lower wheels with the lower wheel guiding members, a portion of each of the lower wheel guiding members being inclined to guide the lower wheels downwardly; supporting upper wheels mounted to an upper end of the frame on upper wheel guiding members of the rack structure that are disposed vertically higher than the lower wheel guiding members; and translating the heat exchanger panel horizontally on the lower and upper wheel guiding members into a final position of the heat exchanger panel whereby the heat exchanger panel is in an inclined position such that a longitudinal axis of the heat exchanger panel, extending from the upper end to the lower end of the frame, is angled relative to a vertical axis.

In some embodiments, the method also includes, prior to lifting the heat exchanger panel, connecting the lifting brackets to a hoist mounted to an upper part of the rack structure in order to lift the heat exchanger panel via the hoist.

In some embodiments, the method also includes, prior to lowering the heat exchanger panel, affixing upper and lower extension portions of respective ones of the upper and lower guiding members to the rack structure, the upper and lower extension portions extending rearwardly of the rack structure; and after the upper wheels are supported by the rack structure, removing the upper and lower extension portions from the upper and lower guiding members.

In some embodiments, in the final position of the heat exchanger panel, the upper wheels and the lower wheels are adjacent to vertical legs of the rack structure so that the vertical legs support a load of the heat exchanger panel.

In some embodiments, the method also includes, prior to lifting the heat exchanger panel, removably connecting wheel mounts to the upper and lower ends of the frame of the heat exchanger panel, the wheel mounts interconnecting the wheels to the frame of the heat exchanger panel, said removably connecting comprising: inserting a rail of each wheel mount into one of: an upper channel defined by an upper frame member of the frame defining the upper end of the frame; and a lower channel defined by a lower frame member of the frame defining the lower end of the frame; and affixing the rail of each wheel mount to one of the upper frame member and the lower frame member via fasteners extending from a front face to a rear face of the one of the upper frame member and the lower frame member.

In some embodiments, while lowering the heat exchanger panel, an axis of the lower wheels describes a downward and generally vertical lower wheel path. The method also includes: prior to supporting the upper wheels on the upper wheel guiding members, reclining the heat exchanger panel so that the upper end of the frame of the heat exchanger panel pivots about the axis of the lower wheels, an axis of the upper wheels thereby describing an arcuate wheel path that intersects the lower wheel path.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
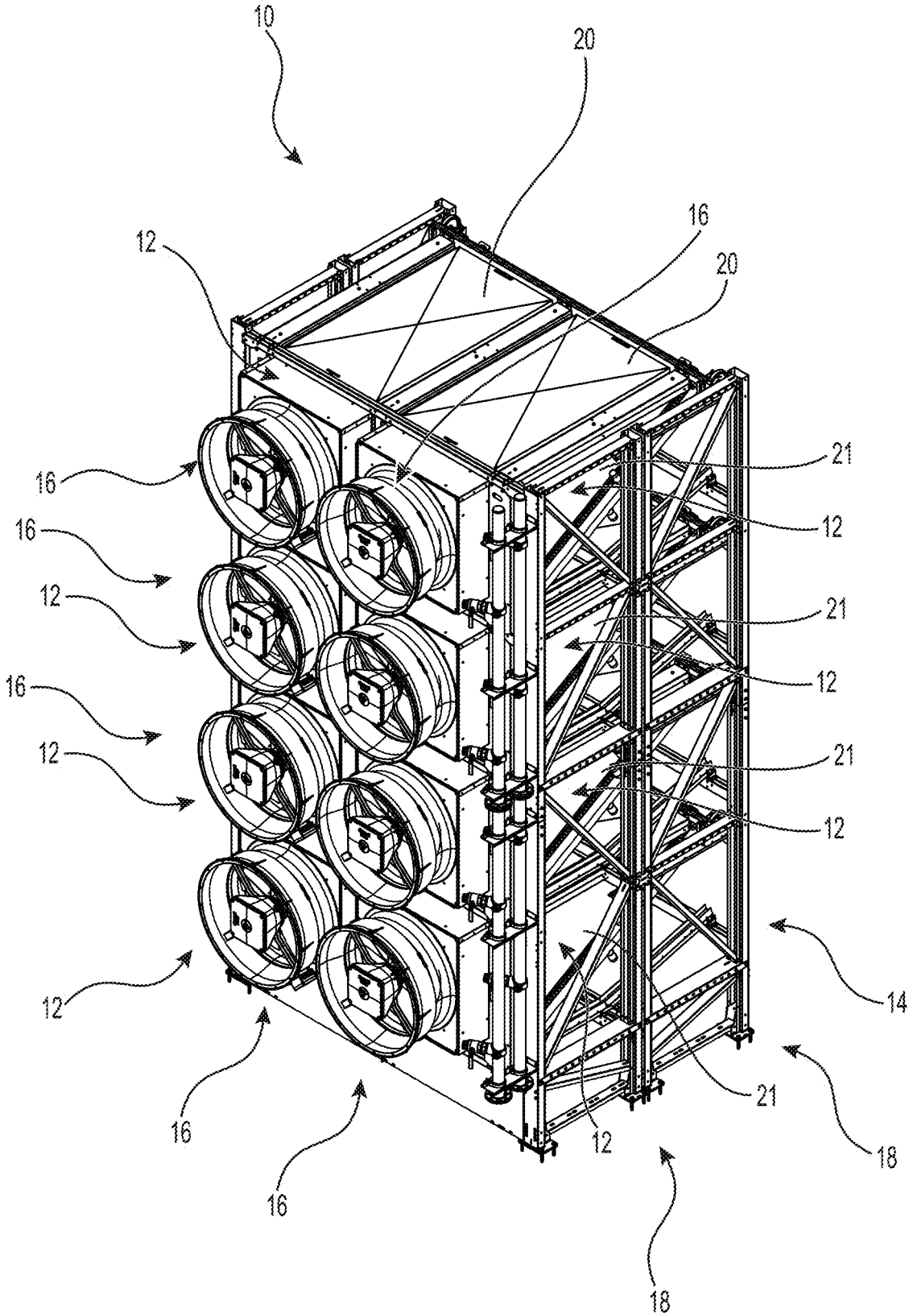
FIG. 1 is a perspective view of a dry cooler stack in accordance with an embodiment of the present technology.

FIG. 1 shows a heat exchanger stack 10 configured to cool fluid flowing therethrough. In particular, in this embodiment, the heat exchanger stack 10 is a dry cooler stack 10 including a plurality of dry coolers 12. However, it is contemplated that the heat exchanger stack 10 may comprise a plurality of any other suitable type of heat exchanger other than a dry cooler (e.g., a condenser, a chiller, etc.).

The dry cooler stack 10 includes a rack structure 14 supporting the dry coolers 12 on a support surface. In use, the rack structure 14 is anchored to the support surface by fasteners. The support surface may be any suitable support surface. For instance, in this embodiment, the support surface is a surface surrounding a building. However, in other embodiments, the support surface could be part of a structure purposefully built to support the rack structure 14. The rack structure 14 will be described in greater detail further below.

The dry coolers 12 of the dry cooler stack 10 are installed on the rack structure such that their respective fan assemblies 16 are on a front side of the dry cooler stack 10 and therefore the dry coolers 12 of the dry cooler stack 10 discharge heated air toward the front side of the dry cooler stack 10.

Figure 5:
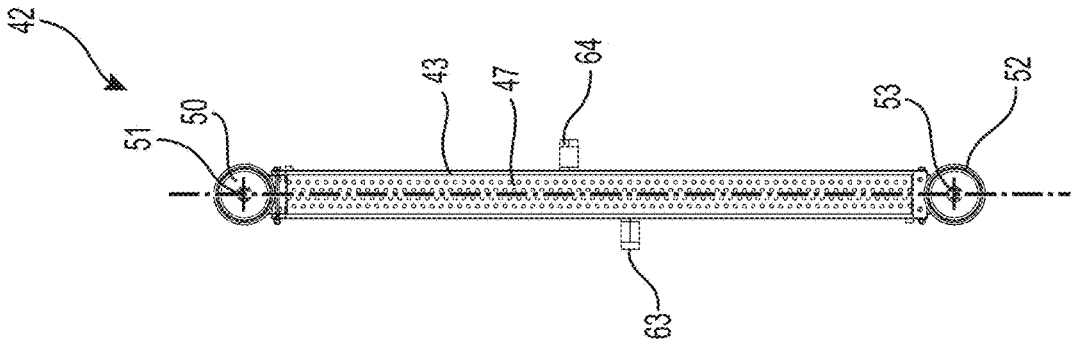
FIG. 5 is a side elevation view of the heat exchanger panel of FIG. 4.
Figure 4:
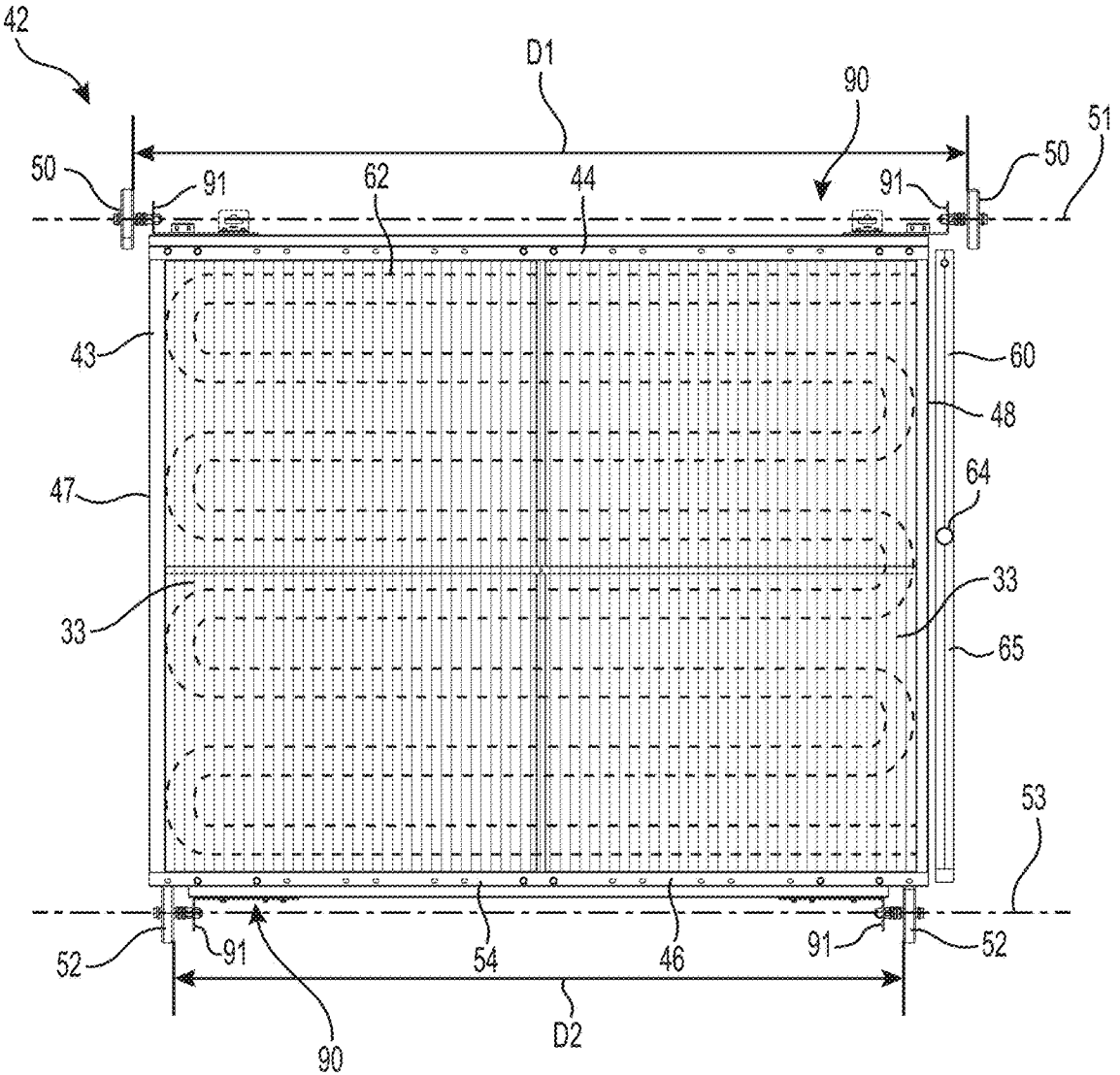
FIG. 4 is front elevation view of a heat exchanger panel of a dry cooler of the dry cooler stack of FIG. 1.
Figure 12:
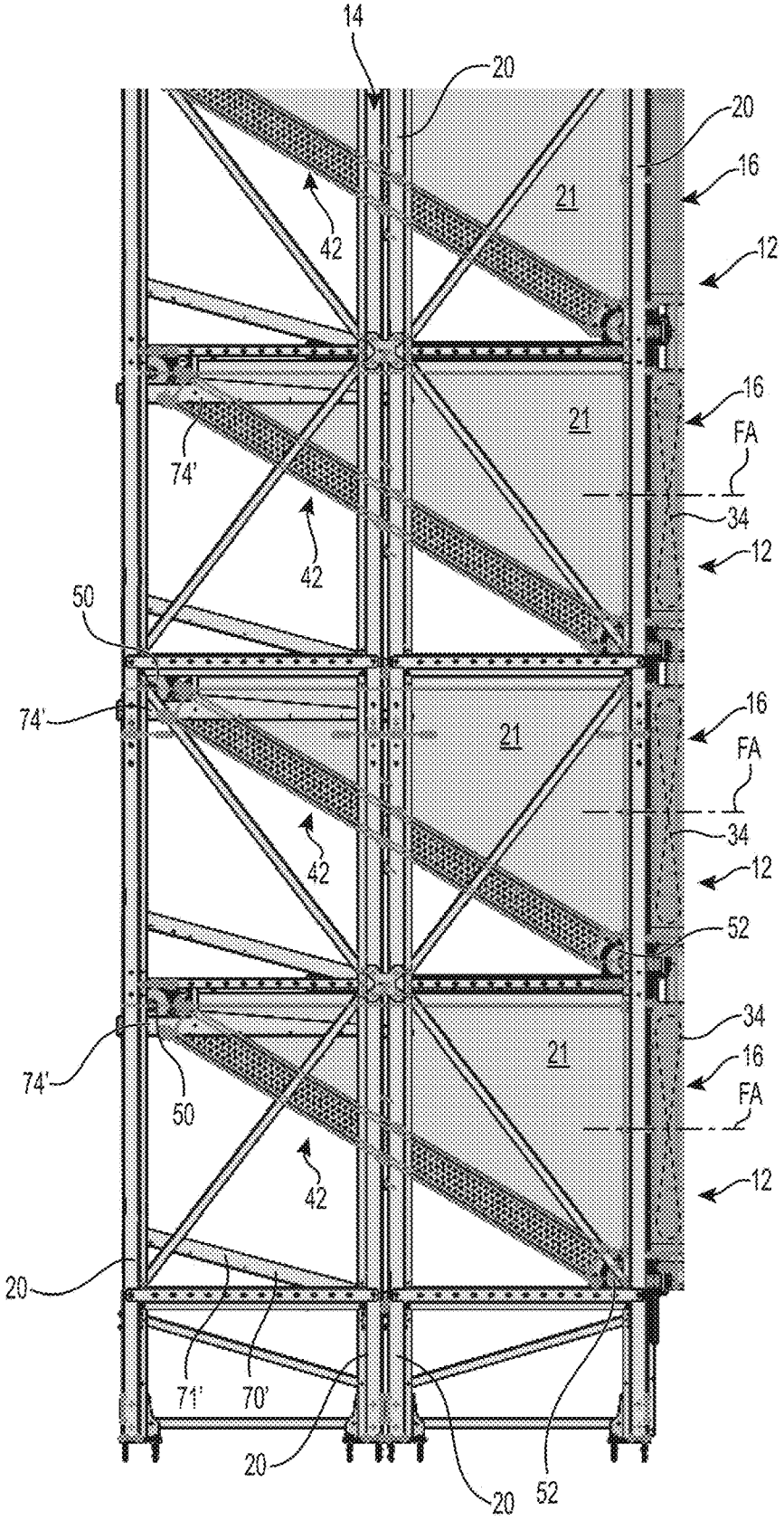
FIG. 12 is a right side elevation view of part of the rack structure of FIG. 11 mounted with the dry coolers, and with removable components of the rack structure removed therefrom.

More specifically, as shown in FIGS. 1 and 12, each dry cooler 12 includes a heat exchanger panel 42, a fan assembly 16, and a plurality of enclosing panels 20, 21 which are mounted to the rack structure 14 to form the dry cooler 12. Together, the heat exchanger panel 42, the fan assembly 16 and the enclosing panels 20, 21 define an interior space of the dry cooler 12. With reference to FIGS. 4 and 5, each dry cooler 12 functions by pumping heated water (extracted from inside the building in this example) through a tubing arrangement 60 of the heat exchanger panel 42 while simultaneously pulling in ambient air between a plurality of fins 33 (FIG. 4) of the heat exchanger panel 42 (as illustrated by arrow A in FIG. 12) to absorb heat from the heated water. Specifically, the ambient air is pulled in through the heat exchanger panel 42 by the corresponding fan assembly 16 of the dry cooler 12 which has a fan impeller 34 that is rotated by a motor (not shown) about a fan rotation axis FA. As air is pulled in through the heat exchanger panel 42 into the interior space of the dry cooler 12, heat is transferred from the water circulating in the heat exchanger panel 42 to the air. The heated air is then discharged from the interior space of the dry cooler 12 through the fan assembly 16. The water circulating in the heat exchanger panel 42 is thus cooled and is recirculated back into the building. This process is performed by each dry cooler 12 of the dry cooler stack 10.

As will be described in greater detail below, the heat exchanger panels 42 of the dry coolers 12 are configured to facilitate mounting of the heat exchanger panels 42 to the rack structure 14. In particular, the heat exchanger panels 42 are provided with rack-engaging members that engage respective guiding members of the rack structure 14.

Figure 2:
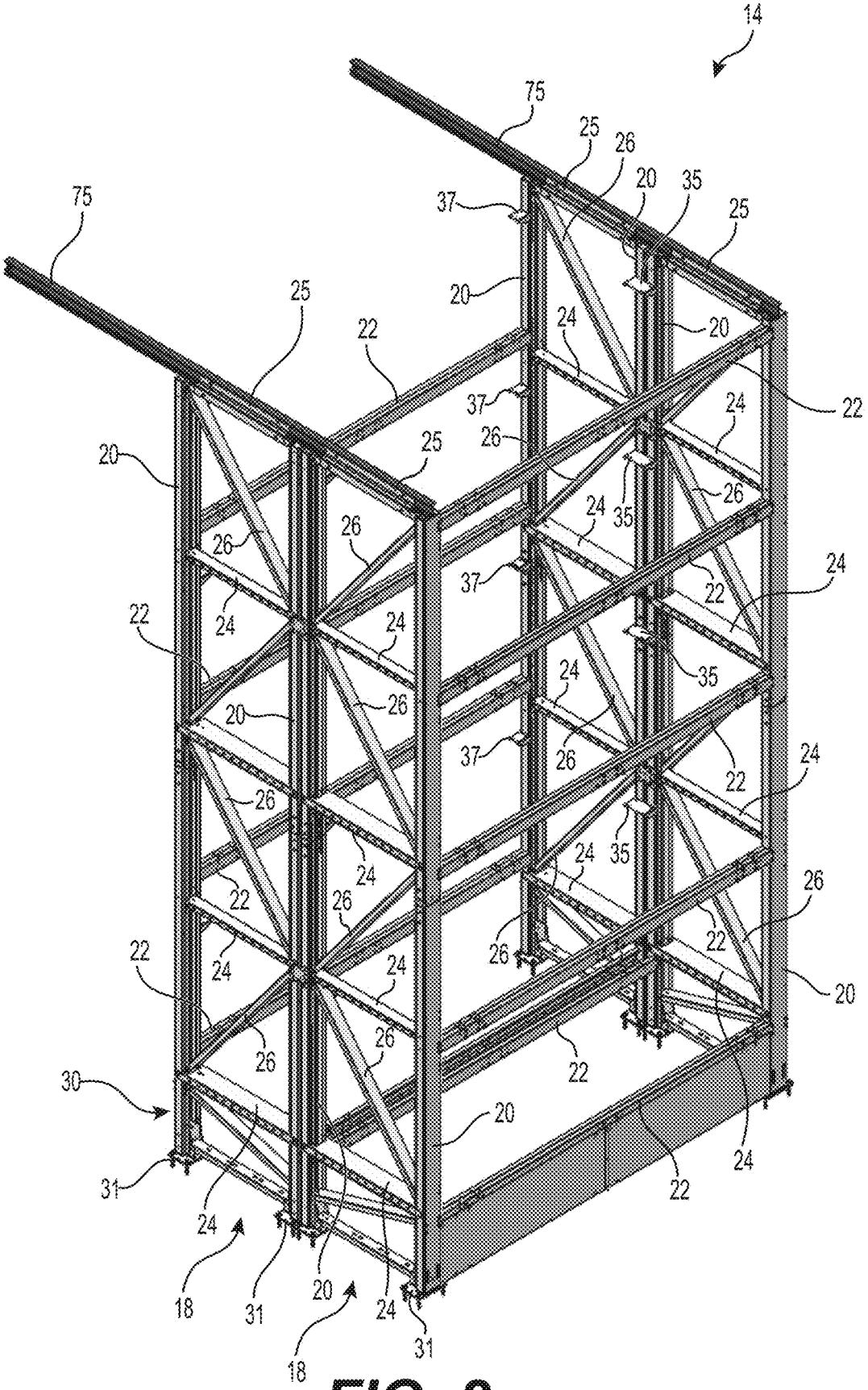
FIG. 2 is a perspective view, taken from a front, right side, of a rack structure of the dry cooler stack of FIG. 1.
Figure 3:
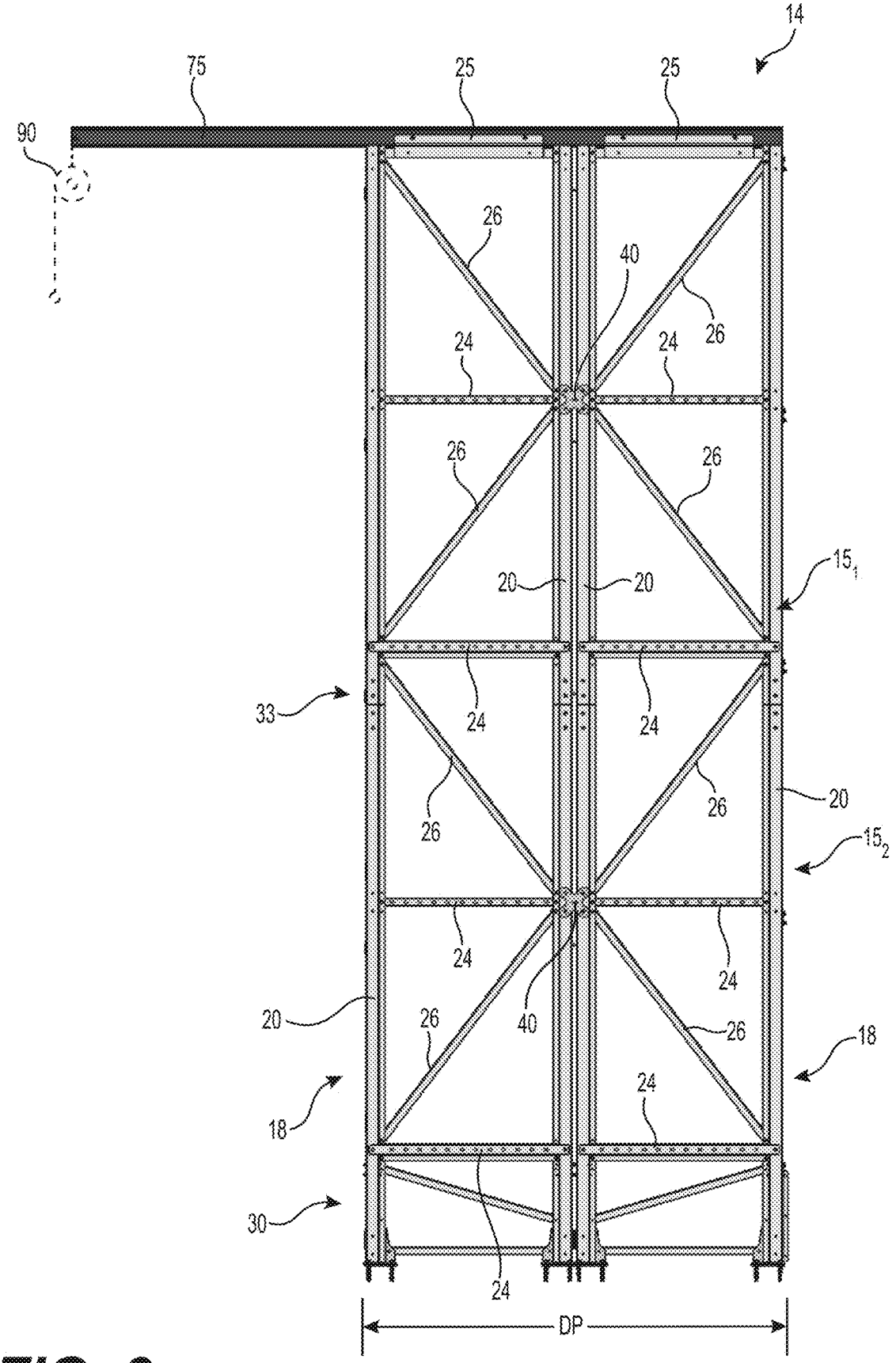
FIG. 3 is a right side elevation view of the rack structure of FIG. 2.

Returning now to FIGS. 1 to 3, in this embodiment, the rack structure 14 has four stories, thus allowing four rows of dry coolers 12 to be installed one on top of the other onto the rack structure 14. More specifically, with reference to FIGS. 2 and 3, the rack structure 14 includes two rack units 18 which are affixed to one another to form the rack structure 14. Each rack unit 18 makes up half of a depth D of the rack structure 14. As can be seen in FIG. 3, a plurality of connectors 40 are provided to connect the two rack units 18 to one another and thereby homogenize forces exerted on the rack structure 14. In this embodiment, each connector 40 is X-shaped and flat. Providing two separate rack units 18 to form the rack structure 14 and connecting them via the connectors 40 allows building a relative tall structure which can support the load of the dry coolers 12 mounted thereto as well as loads applied thereto by environmental factors such as winds and snow. Furthermore, this may allow reducing a risk of buckling of the sheet metal components from which the rack structure 14 is made.

Both rack units 18 are configured similarly and thus only one of the rack units 18 will be described in detail below. It is to be understood that the description applies to the other rack unit 18 as well.

The rack unit 18 includes four vertical legs 20 positioned at the corners of the rack unit 18 to define the rectangular shape of the rack unit 18. A flange 31 is provided at the lower end of each vertical leg 20 for anchoring the rack unit 18 to the support surface on which the rack unit 18 is mounted. The vertical legs 20 are linked by laterally-extending horizontal members 22 which extend between and interconnect laterally-adjacent ones of the vertical legs 20. The horizontal members 22 define the number of stories of the rack structure 14. In this embodiment, each rack unit 18 has five horizontal members 22. The rack unit 18 also has longitudinally-extending horizontal members 24 extending between and interconnecting longitudinally-adjacent ones of the vertical legs 20. The horizontal members 22, 24 are generally vertically aligned with one another. Moreover, each rack unit 18 also has a plurality of diagonal connecting members 26 which extend diagonally between vertically-adjacent ones of the longitudinally-extending horizontal members 24. As such, the diagonal connecting members 26 are disposed on each lateral side of the rack unit 18.

The components of the rack unit 18 can be fastened to one another in any suitable way. In this embodiment, the components of the rack sub-unit 18 are bolted to one another. It is contemplated that, in other embodiments, the components of the rack sub-unit 18 could be welded to one another.

As mentioned above, the connectors 40 interconnect the two rack units 18 to one another. In particular, two ends of each X-shaped connector 40 are fastened (e.g., bolted or welded) to one of the vertical legs 20 of one of the rack units 18 and the two other ends of the X-shaped connector 40 are fastened to an adjacent vertical leg 20 of the other rack unit 18.

As will be described in greater detail below, the rack structure 14 and the heat exchanger panels 42 of the dry coolers 12 are configured so as to facilitate mounting of the heat exchanger panels 42 onto the rack structure 14 to assemble the dry coolers 12. Notably, as shown in FIGS. 2 and 3, the rack structure 14 is provided with two rails 75 which support a respective hoist system 57 for lifting the heat exchanger panels 42 so as to mount them in their defined place on the rack structure 14. The rails 75 are laterally spaced from one another and connected to the upper ends of the rack units 18. In particular, each rail 75 is fastened to two laterally-spaced upper brackets 25 of each rack unit 18. The upper brackets 25 are connected to the topmost longitudinally-extending horizontal members 24. In this embodiment, each rail 75 is an I-beam and the upper brackets 25 are shaped to be fastened to a central portion of the rails 75 between the wide ends thereof. As such, each rail 75 is slidable between the upper brackets and is fastened thereto. The rails 75 protrude from the rear side of the rack structure 14. A respective hoist system 57 is connected near the end of each rail 75. The hoist system 57 may be manually operated or electrically operated.

As shown in FIGS. 6 to 10, in order to receive the wheeled heat exchanger panels 42 within the rack structure 14, the rack structure 14 is provided with a plurality of lower guiding members 70 and a plurality of upper guiding members 74 which are vertically spaced from one another. In particular, a pair of the lower guiding members 70 and a pair of the upper guiding members 74 together receive a corresponding heat exchanger panel 42. In this embodiment, the guiding members 70, 74 receive respective wheels of the heat exchanger panels 42 and therefore may be referred to as lower and upper "wheel guiding members" 70, 74.

Figure 6:
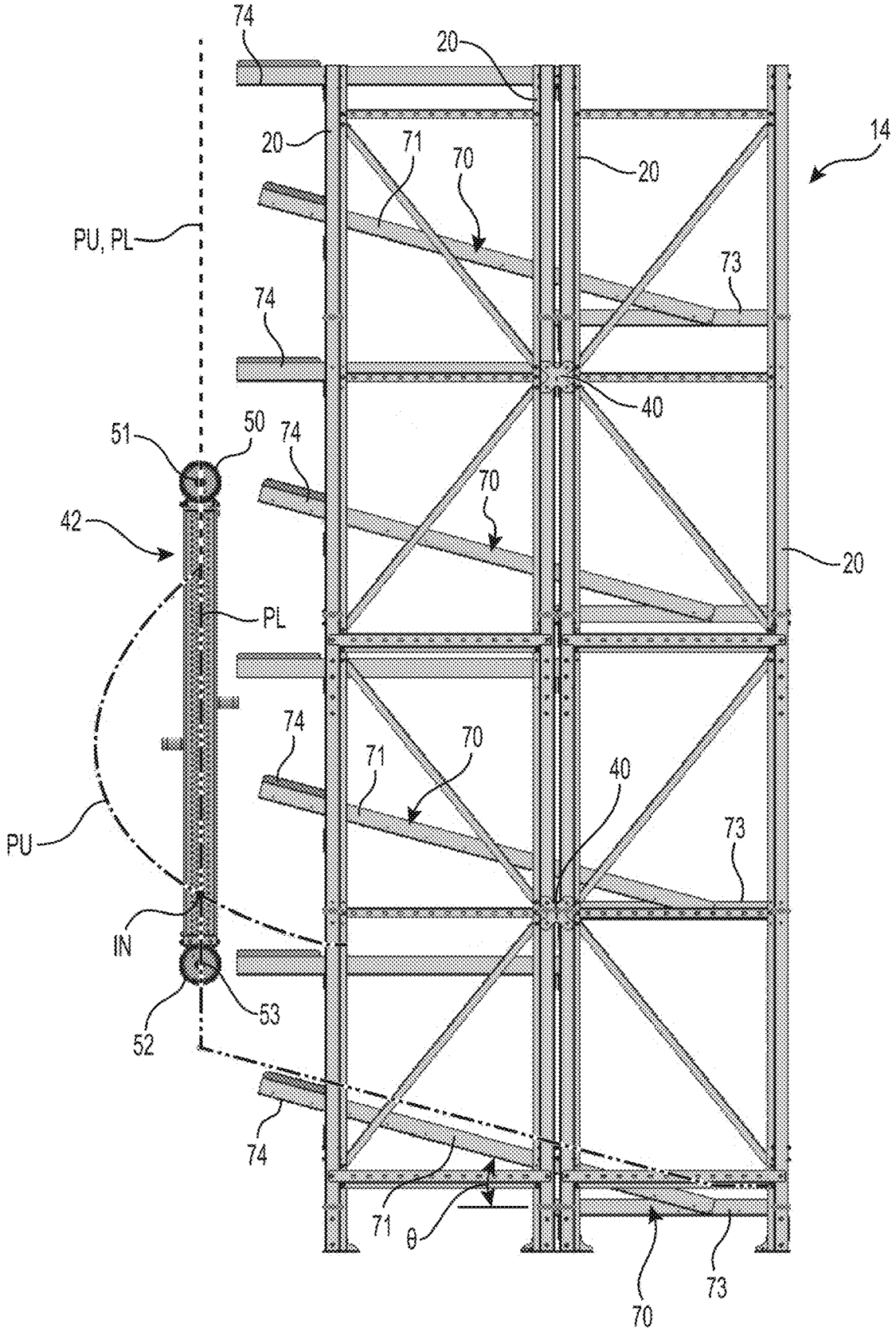
FIG. 6 is a side elevation view of part of the rack structure of FIG. 2 with a heat exchanger panel in a first position while it is being mounted to the rack structure.
Figure 9:
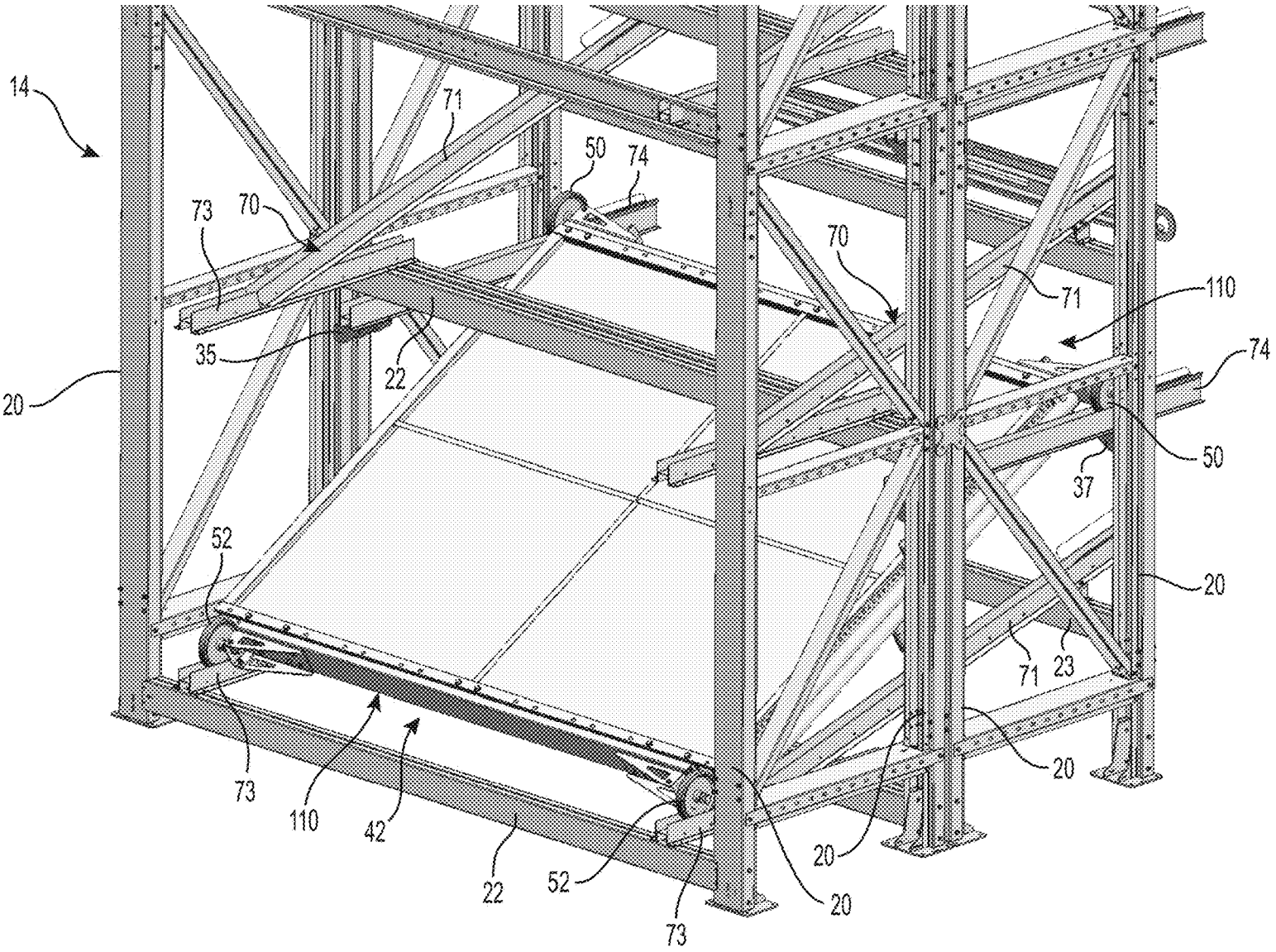
FIG. 9 is a perspective view, taken from a front, left side, of a part of the rack structure of FIG. 2 with a bottommost heat exchanger panel mounted thereto in its final position.
Figure 10:
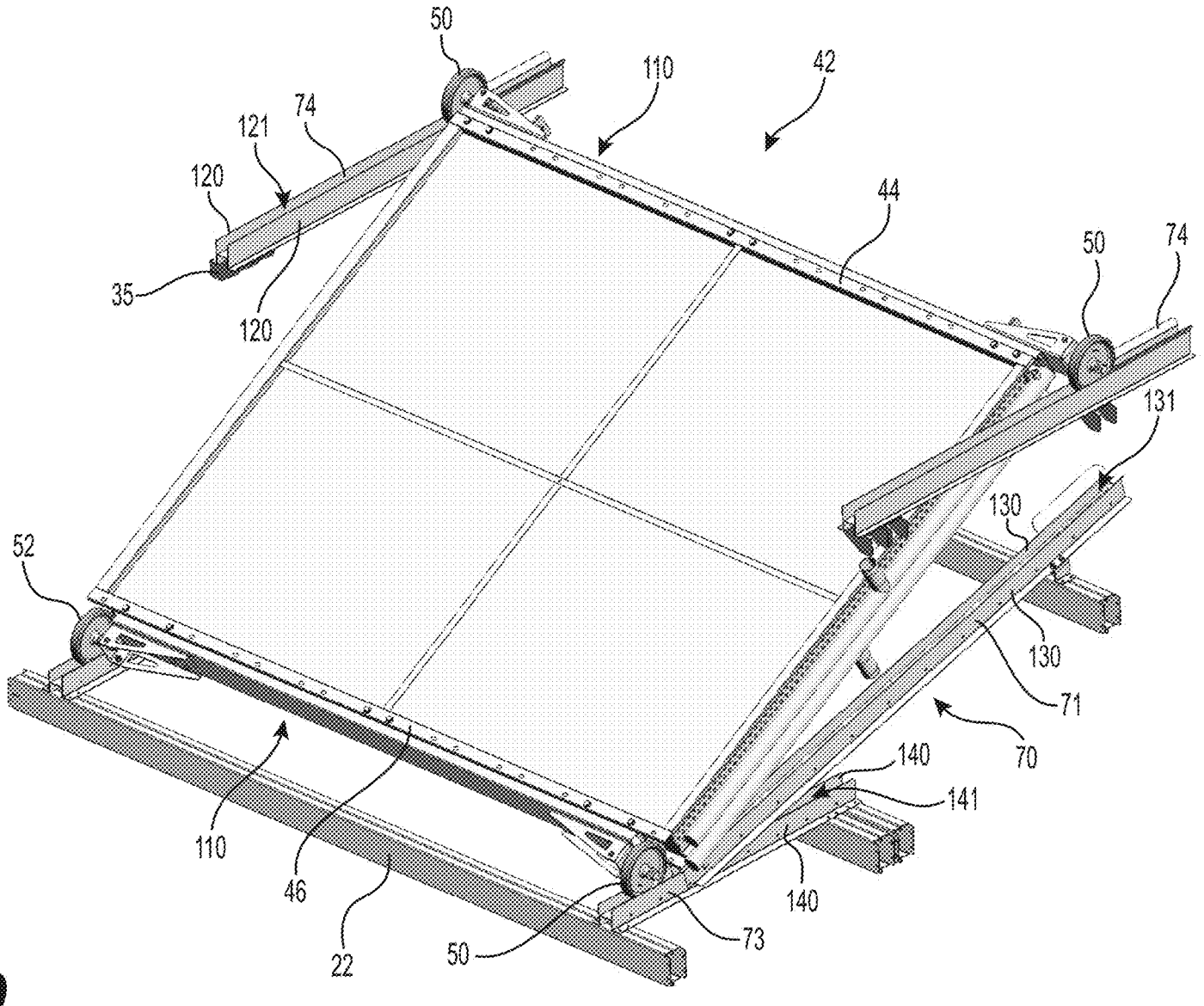
FIG. 10 is another perspective view of the heat exchanger panel of FIG. 9 with many components of the rack structure removed for clarity.

As best seen in FIGS. 9 and 10, the lower wheel guiding members 70 are supported by and connected to the laterally-extending horizontal members 22 and laterally-extending wheel guide supports 23. Each lower wheel guiding member 70 includes a horizontal portion 73 and an angled portion 71 that is angled relative to the horizontal portion 73. The horizontal and angled portions 71 are elongated members. Notably, the angled portion 71 extends upwardly and rearwardly from the horizontal portion 73. More specifically, in this embodiment, as shown in FIG. 6, the angled portion 71 extends at an angle θ of approximately 15° relative to the horizontal portion 73. In some embodiments, the angled portion 71 may extend at an angle between 10° and 75° relative to the horizontal portion 73. Notably, this range of values of the angle θ may provide a compact path of the heat exchanger panels 42 when being mounted to the rack structure 14, as will be discussed in greater detail below.

As shown in FIGS. 6 and 10, the horizontal portion 73 extends longitudinally and is supported by and connected to longitudinally-adjacent ones of the horizontal members 22. The angled portion 71 is connected, at its lower end, to the horizontal portion 73 and, near to its upper end, to a corresponding one of the laterally-extending wheel guide supports 23. The laterally-extending wheel guide supports 23 extend between and are connected to laterally-adjacent ones of the vertical legs 20.

The lower wheel guiding members 70 are configured to receive and guide the wheels of the heat exchanger panel 42. Therefore, in this embodiment, the angled and horizontal portions 71, 73 have a generally U-shaped cross-sectional profile. Specifically, in this embodiment, as shown in FIG. 10, the angled portion 71 has opposite parallel walls 130 defining a channel 131 therebetween. Similarly, the horizontal portion 73 has opposite parallel walls 140 defining a channel 141 therebetween. When a heat exchanger panel 42 is being mounted to the rack structure 14, lower wheels of the heat exchanger panel 42 roll on bottom surfaces extending between the walls 130, 140 while the parallel walls 130, 140 guide the lower wheels, thereby preventing the wheels from disengaging the lower wheel guiding members 70.

As shown in FIGS. 9 and 10, the upper wheel guiding members 74 are supported by and connected to the vertical legs 20 via support brackets 35, 37. In particular, the upper wheel guiding members 74 are disposed atop the support brackets 35, 37 which are affixed to the vertical legs 20. Each upper wheel guiding members 74 is elongated and has two parallel walls 120 defining a channel 121 therebetween. When a heat exchanger panel 42 is being mounted to the rack structure 14, upper wheels of the heat exchanger panel 42 roll on a bottom surface extending between the walls 120 while the parallel walls 120 guide the wheels, thereby preventing the wheels from disengaging the upper wheel guiding members 74.

Figure 7:
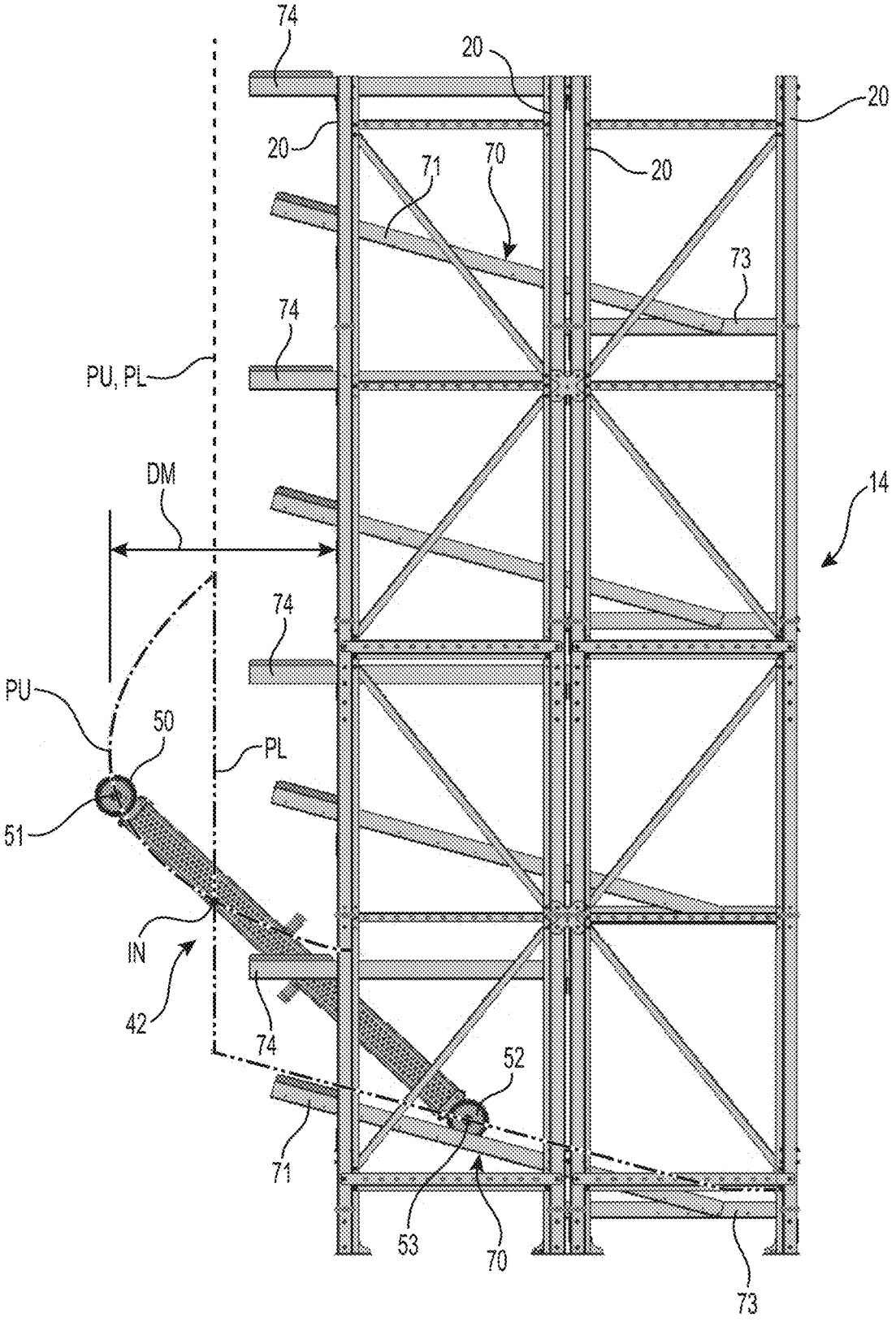
FIG. 7 is a side elevation view of the part of the rack structure of FIG. 6 with the heat exchanger panel in a second position while it is being mounted to the rack structure.
Figure 8:
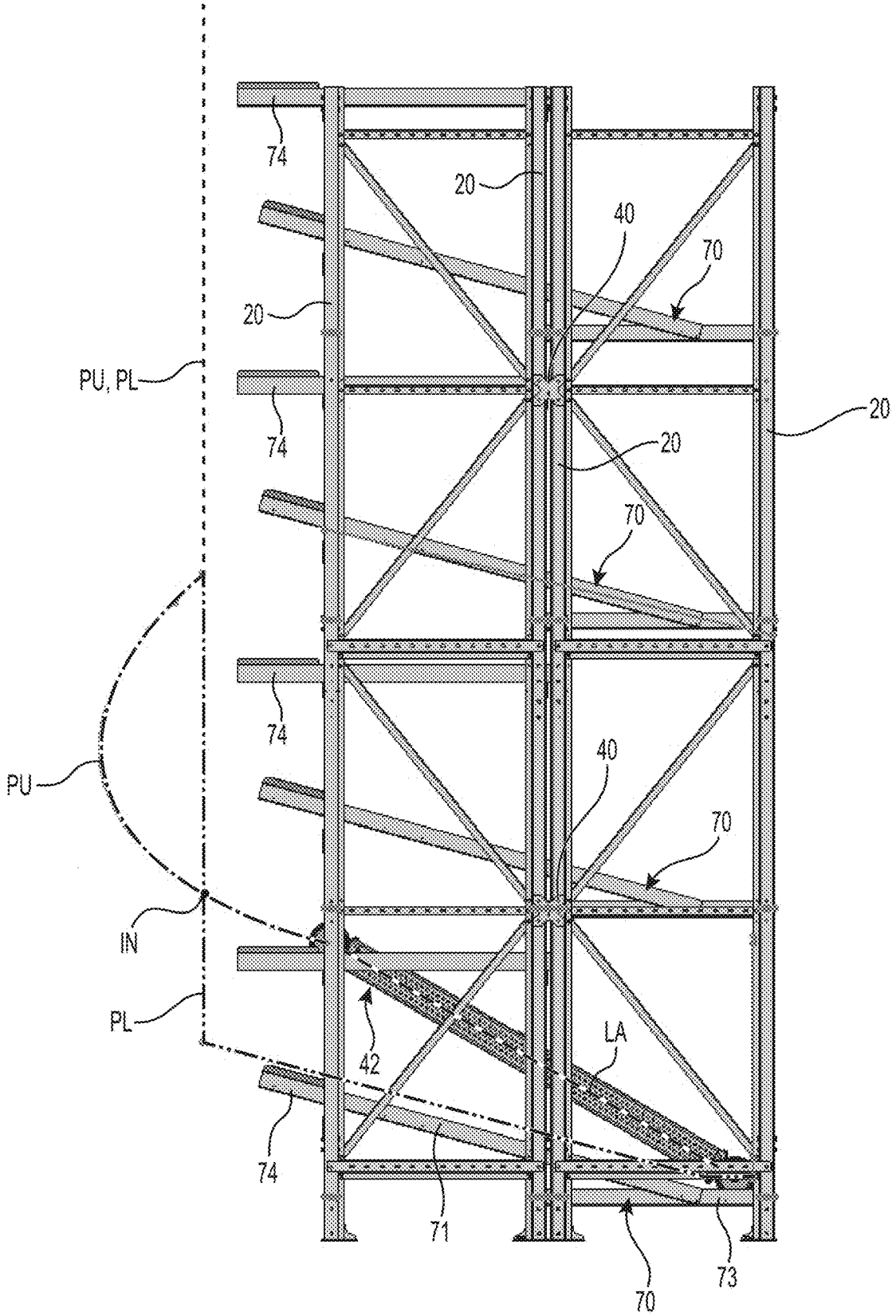
FIG. 8 is a side elevation view of the part of the rack structure of FIG. 6 with the heat exchanger panel in a final position while it is being mounted to the rack structure.

As shown in FIGS. 6 to 8, in this embodiment, the lower and upper wheel guiding members 70, 74 extend rearwardly past the rearmost vertical legs 20. As such, in this embodiment, the lower and upper wheel guiding members 70, 74 extend past the depth DP of the rack structure 14. However, it is contemplated that in other embodiments, the lower and upper wheel guiding members could not extend rearwardly past the rearmost vertical legs 20.

Figure 11:
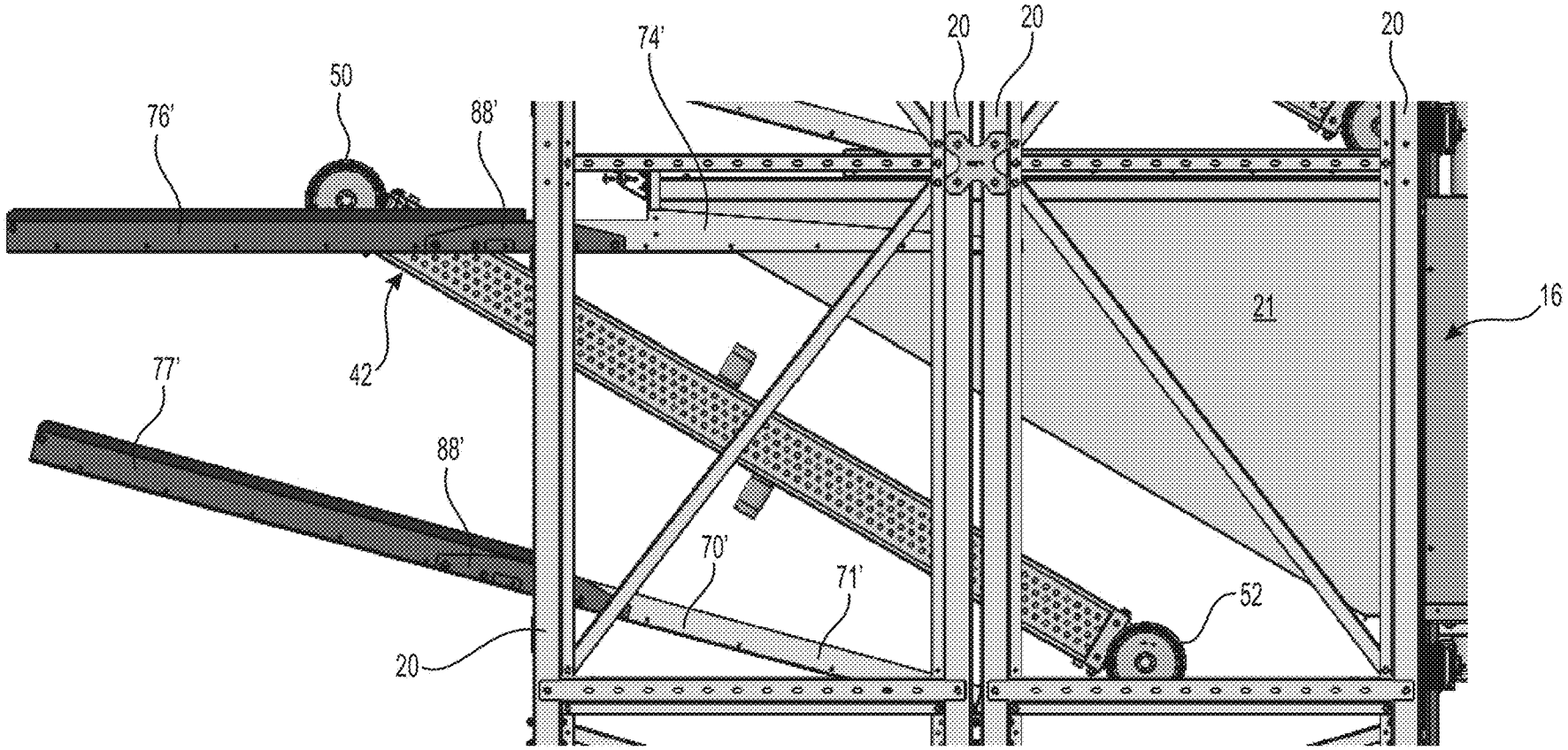
FIG. 11 is a right side elevation view of part of the rack structure of FIG. 2 in accordance with an alternative embodiment, with a heat exchanger panel shown being mounted thereto.
Figure 13:
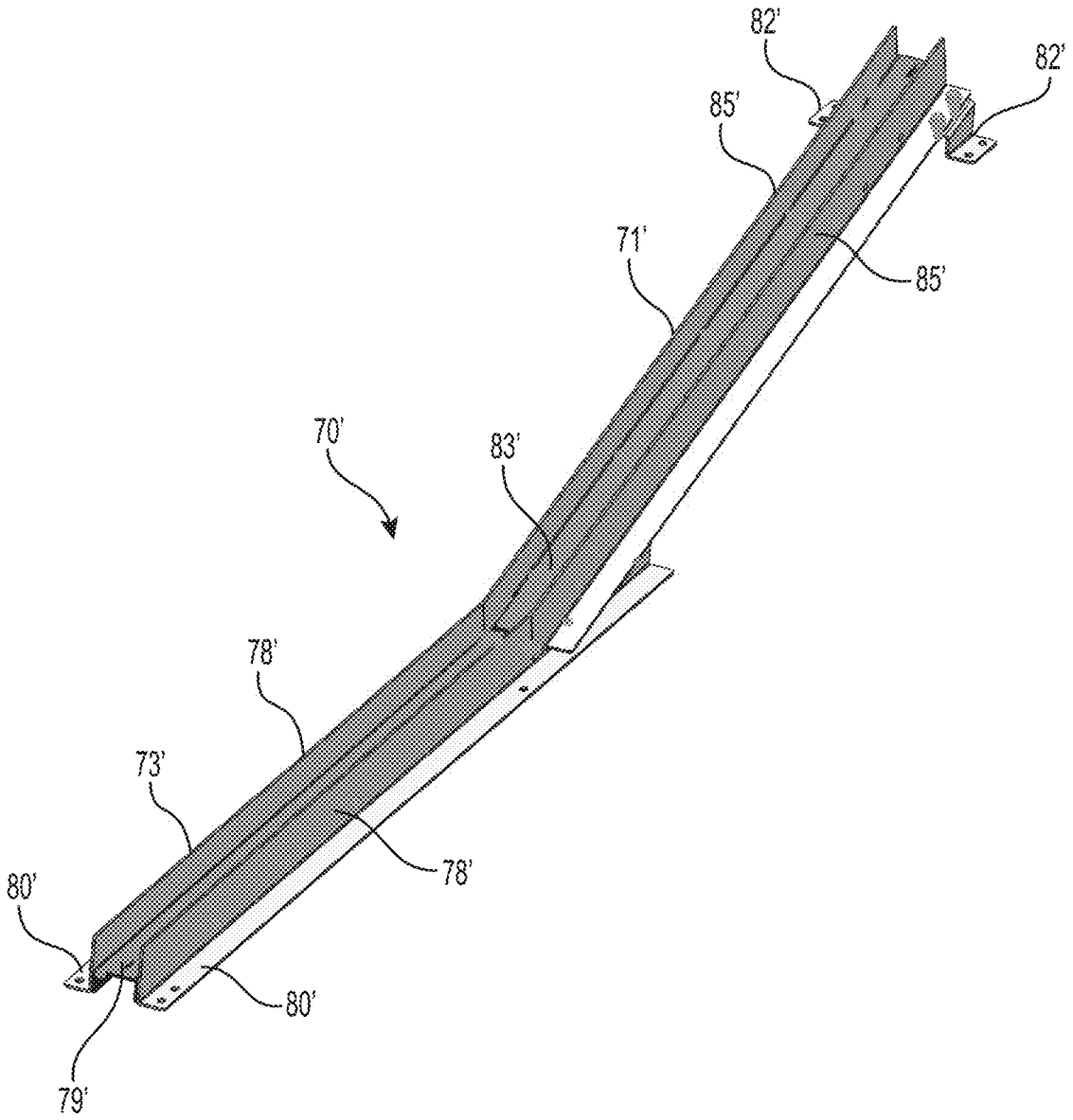
FIG. 13 is a perspective view of a lower wheel guiding member of the rack structure of FIG. 11.

For instance, with reference to FIGS. 11 to 13, in some embodiments, the rack structure 14 has lower wheel guiding members 70' and upper wheel guiding members 74' for receiving the wheeled heat exchanger panels 42. In particular, a pair of the lower wheel guiding members 70' and a pair of the upper wheel guiding members 74' together receive a corresponding heat exchanger panel 42. In this embodiment, the lower and upper wheel guiding members 70', 74' do not extend rearwardly past the rearmost vertical legs 20 of the rack structure 14. However, in order to allow the wheels of the heat exchanger panel 42 to be received "outside" of the rack structure 14, removable lower guide extensions 77' and removable upper guide extensions 76' are provided which are removably connectable to the lower and upper wheel guiding members 70', 74' respectively.

As shown in FIG. 13, each lower wheel guiding member 70' has a horizontal portion 73' and an angled portion 71' extending at an angle relative to the horizontal portion 73'. The horizontal portion 73' is supported by and connected to longitudinally-adjacent ones of the horizontal members 22. The angled portion 71' is connected, at its lower end, to the horizontal portion 73' and, at its upper end, to a corresponding one of the laterally-extending wheel guide supports 23. In particular, flanges 80' extending outwardly from the parallel walls 78' are connected to the horizontal members 22, and supporting legs 82' extending downwardly from the upper end of the angled portion 71' are connected to the laterally-extending wheel guide supports 23. In this embodiment, the angle formed between the angled portion 71' and the lower portion 73' is less than that between the angled portion 71 and the lower portion 73 described above, namely since the angled portion 71' is connected to the lower portion 73' at a point further rearward. As such, the vertical distance between the laterally-extending wheel guide supports 23 and corresponding horizontal members 22 is smaller.

The angled and horizontal portions 71', 73' have a generally U-shaped cross-sectional profile. Notably, the horizontal portion 73' has two parallel opposite walls 78' and a channel defined therebetween. Similarly, the angled portion 71' has two parallel opposite walls 85' and a channel defined therebetween. When a heat exchanger panel 42 is being mounted to the rack structure 14, lower wheels of the heat exchanger panel 42 roll on bottom surfaces 83', 79' extending between the walls 78', 85' while the parallel walls 78', 85' guide the lower wheels, thereby preventing the wheels from disengaging the lower wheel guiding members 70'.

The upper wheel guiding members 74' are substantially similar to the upper wheel guiding members 74 described above except that they are size so as to not extend rearward from the rearmost vertical legs 20. The upper wheel guiding members 74' will therefore not be described in detail herein.

The removable lower guide extensions 77' and removable upper guide extensions 76' have a generally U-shaped cross-sectional profile for receiving wheels of the heat exchanger panels 42 therein. As shown in FIG. 11, the removable lower and upper guide extensions 77', 76' are connected respective ones of the lower wheel guiding members 70' (to the angled portion 71' thereof specifically) and to the upper wheel guiding members 74' via connecting brackets 88' which surround the bottom walls of the lower wheel guiding members 70' and the upper wheel guiding members 74' for connection to the lower and upper guide extensions 77', 76'.

The heat exchanger panels 42, which are configured to transfer heat from the fluid circulating therein into the air flowing therethrough, will now be described in greater detail below with reference to FIGS. 4 and 5. Since the heat exchanger panels 42 are all identical in this embodiment, only one of the heat exchangers 42 will be described in detail herein. It is to be understood that the same description applies to the other heat exchanger panels 42.

The heat exchanger panel 42 has a frame 43 for supporting the various components of the heat exchanger 42. The frame 43 has an upper end 44 and a lower end 46 opposite the upper end 44, as well as opposite lateral ends 47, 48. Together, the ends 44, 46, 47, 48 define a generally rectangular shape of the frame 43 and of the heat exchanger panel 42. The tubing arrangement 60 of the heat exchanger panel 42, which as mentioned above is configured to circulate fluid therein, is supported by the frame 43. As can be seen in FIG. 4, a portion 62 of the tubing arrangement 60 extends in a serpentine path across a majority of a width and a length of the frame 43 within the boundaries defined by the ends of the frame 43. A header portion 65 of the tubing arrangement 60 extends outside of the frame 43, adjacent to the lateral end 48 thereof, and defines an inlet 63 and an outlet 64 for respectively receiving fluid into and discharging fluid out of the tubing arrangement 60. It should be understood that the path traced by the portion 42 of the tubing arrangement 60 has been simplified in the drawings for practicality; the path traced thereby may vary in other embodiments. The fins 33 of the heat exchanger panel 42 are in thermal contact with the portion 62 of the tubing arrangement 60 so as to increase a heat exchange surface area of the heat exchanger panel 42. The fins 33 are spaced apart from one another to allow air to flow therebetween and into the interior space of the corresponding dry cooler 12.

The heat exchanger panel 42 is provided with a plurality of rack-engaging members 50, 52 which are mounted to the frame 43 and which, as will be described in greater detail below, are configured to engage respective guiding members of the rack structure 14 for guided mounting of the heat exchanger panel 42 on the rack structure 14. In this embodiment, the rack-engaging members 50, 52 are wheels 50, 52 which are configured to roll on respective wheel guiding members of the rack structure 14. The wheels 50, 52 are mounted to the frame 43 in such a way as to be rotatable about a respective axis 51, 53 that extends generally laterally (i.e., in a side-to-side direction of the heat exchanger panel 42). The wheels 50, 52 include an upper set of wheels 50 mounted to the upper end 44 of the frame 43 and a lower set of wheels 52 mounted to the lower end 46 of the frame 43. The upper set of wheels 50 includes two upper wheels 50 spaced apart from one another by a distance D1. The wheels 50, 52 also include a lower set of wheels 52 mounted to the lower end 46 of the frame 43. The lower set of wheels 52 includes two lower wheels 52 spaced apart from one another by a distance D2.

It is contemplated that the wheels 50, 52 could be other types of rack-engaging members such as, for example, anti-friction members that slide on the guiding members 70, 74 of the rack structure 14.

In order to ensure that a path of the heat exchanger panel 42 when being mounted to the rack structure 14 is relatively compact such that the heat exchanger panel 42 stays relatively close to the rack structure 14 when being mounted thereto, the heat exchanger panel 42 is designed such that the distances D1 and D2 are different from one another (i.e., unequal to one another). As such, as shown in FIG. 4, the upper wheels 50 are spaced laterally outwardly from the lateral ends 47, 48 of the frame 43 of the heat exchanger panel 42. On the other hand, the lower wheels 52 are spaced laterally inwardly from the lateral ends 47, 48 of the frame 43 of the heat exchanger panel 42. In particular, in this embodiment, the distance D1 is greater than the distance D2. For instance, a ratio of the distance D1 over the distance D2 may be between 1.1 and 1.5. In this embodiment, the ratio of the distance D1 over the distance D2 is approximately 1.2 (±0.1). As will be understood, the lower and upper wheel guiding members described above are positioned in accordance with the distances D1, D2 so as to receive and guide the wheels 50, 52.

As will be shown below when describing the path of the heat exchanger panel 42 when being mounted to the rack structure 14, this difference between the distances D1, D2 ensures that the upper wheels 50 and the lower wheels 52 move along different planes when the heat exchanger panel 42 is being mounted to the rack structure 14 and therefore that the path of the axis of the upper wheels 50 can intersect the path of the axis of the lower wheels 52 during installation on the rack structure 14. This may provide a compact installation path of the heat exchanger panel 42 as it is being installed onto the rack structure 14 which results in a relatively small amount of space being required on a rear side 15 of the rack structure 14 to mount the heat exchanger panels 42 to the rack structure 14. In turn, this results in footprint savings in the environment in which the dry cooler stack 10 is being installed as less space is required to remain unused behind the rack structure 14 to install the heat exchanger panels 42 thereto. This is particularly useful for example along a facade of a building or the roof of a building such as that housing a data center where a considerable amount of equipment has to be provided on the roof to service the data center properly.

With reference to FIGS. 4 and 14 to 16, the wheels 50, 52 are mounted to the upper and lower ends 44, 46 of the frame 43 of the heat exchanger panel 42 via wheel mounts 90. Notably, in this embodiment, an upper wheel mount 90 is configured to mount the upper wheels 50 to the upper end 44 of the frame 43 while a lower wheel mount 90 is configured to mount the lower wheels 52 to the lower end 46 of the frame 43.

Figure 14:
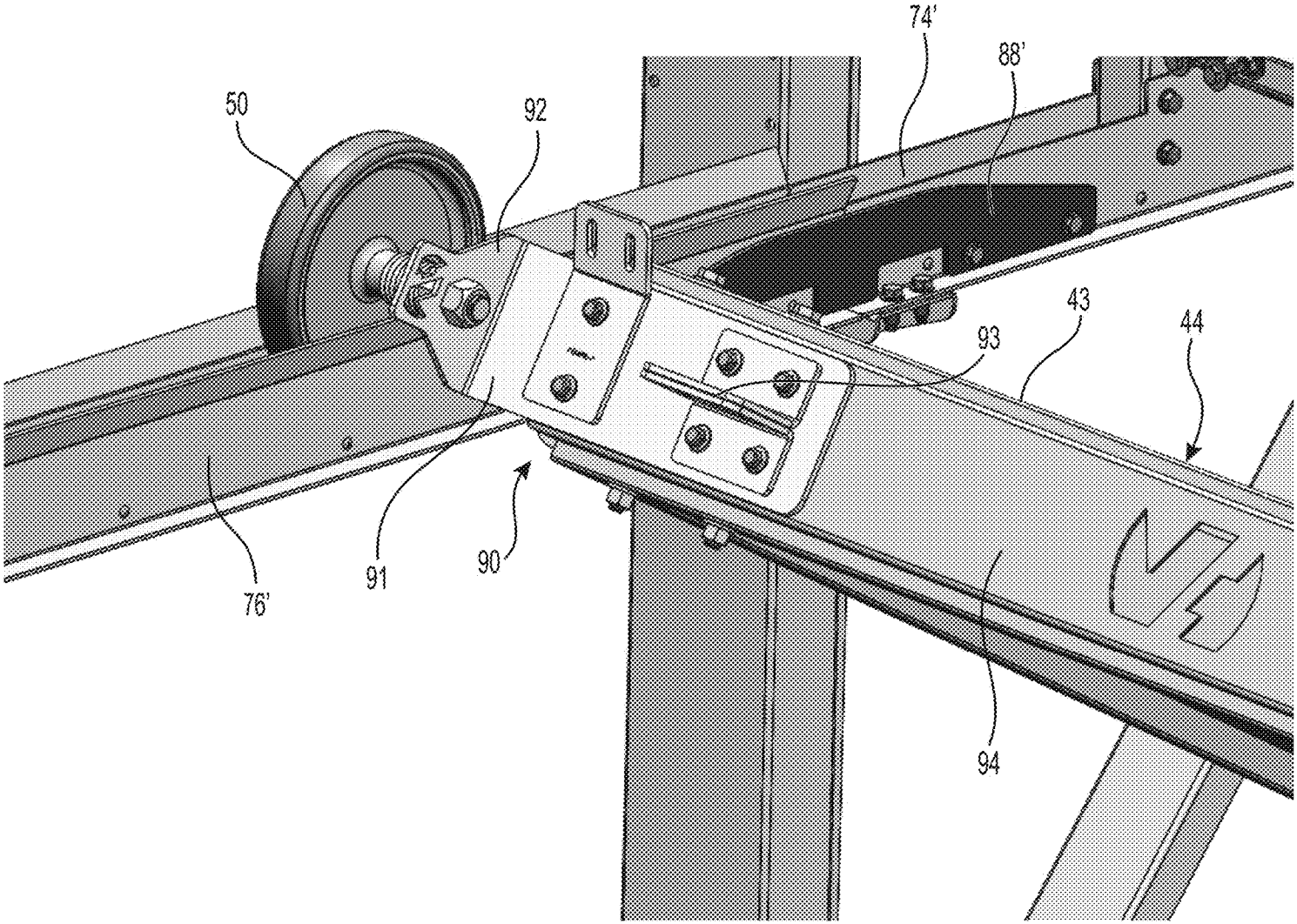
FIG. 14 is a perspective view of part of an upper end of the heat exchanger panel of FIG. 4.
Figure 15:
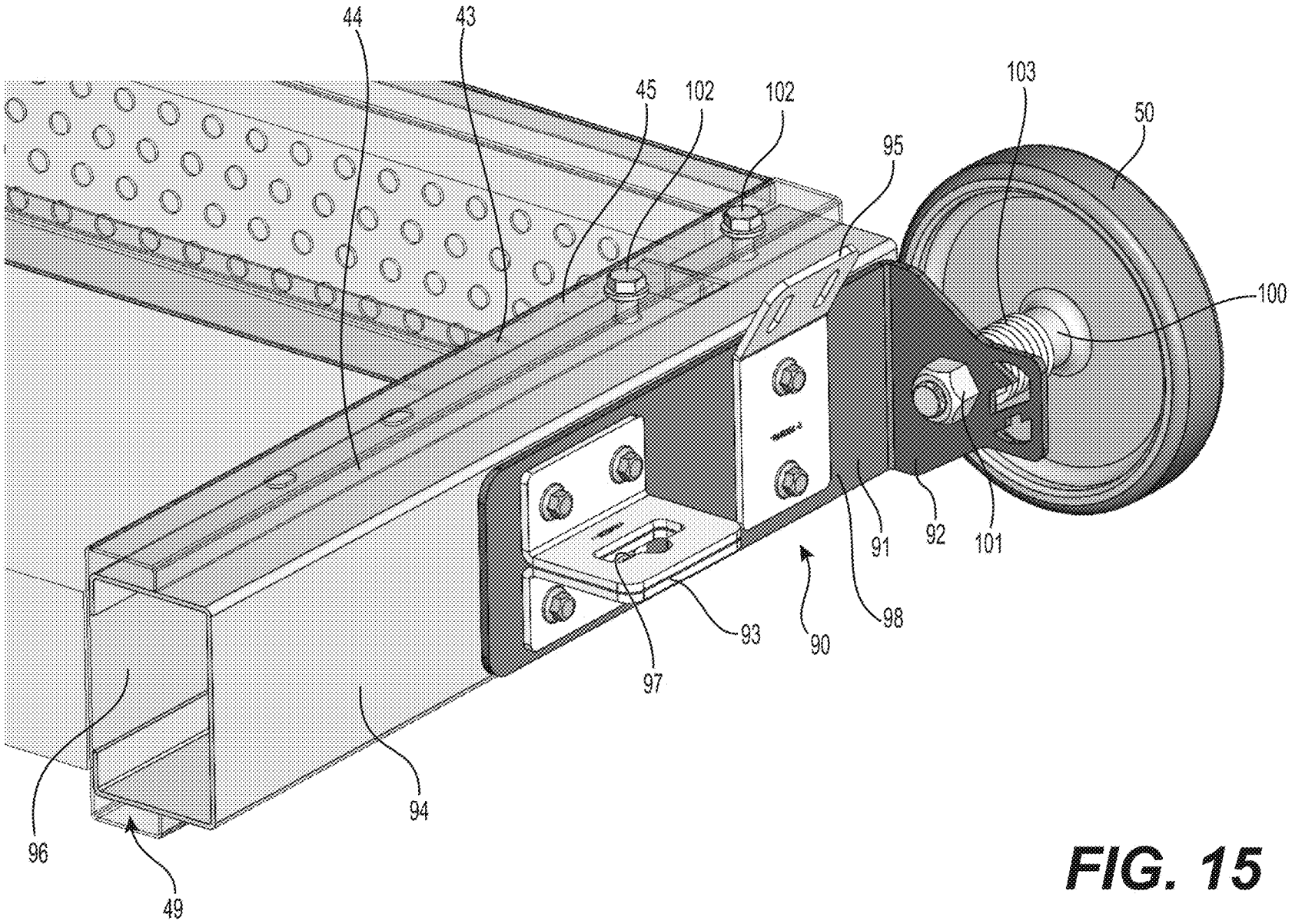
FIG. 15 is a perspective view of a cross-section of part of the upper end of the heat exchanger panel of FIG. 4.
Figure 16:
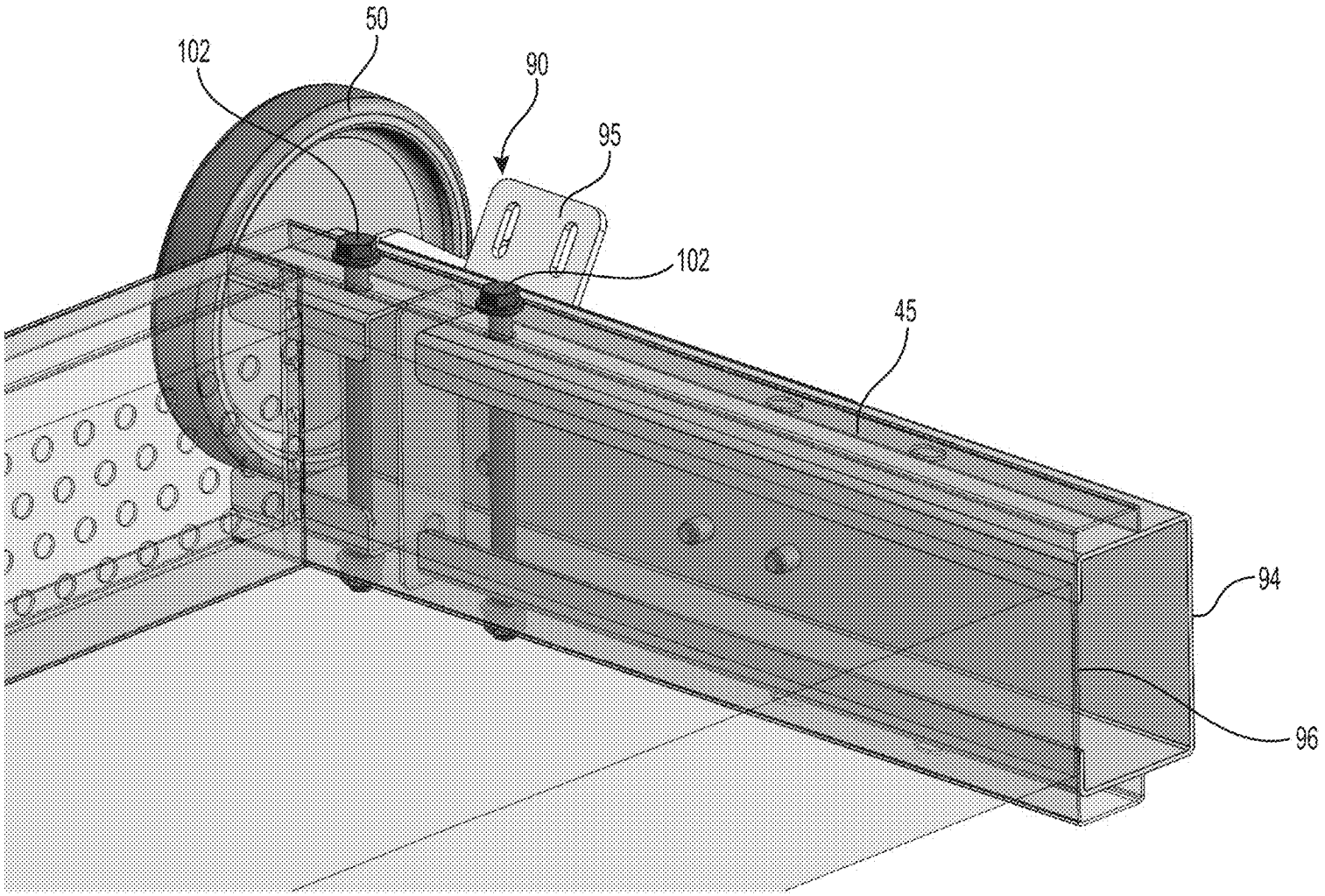
FIG. 16 is another perspective view of the cross-section of the part of the upper end of the heat exchanger panel of FIG. 15.

As shown in FIGS. 14 and 15, the upper wheel mount 90 includes a removable connector 94 that is attached to the upper end 44 of the frame 43. In particular, the removable connector 94 of the upper wheel mount 90 is connected to an upper frame member 45 of the frame 43 which defines the upper end 44 thereof. More specifically, the removable connector 94 is inserted within a channel 49 defined by the upper frame member 45 and which extends laterally between the opposite lateral ends 47, 48 of the frame 43. As shown in FIG. 15, the channel 49 has a bottom surface 96.

In this embodiment, the removable connector 94 is an elongated rail having a generally rectangular cross-sectional profile, and the channel 49 is appropriately shaped and dimensioned to receive the removable connector 94 therein. In order to secure the removable connector 94 in the channel 49 of the upper frame member 45, fasteners 102 (FIGS. 15, 16) extend through the upper frame member 45 and the removable connector 94 transversally to their direction of elongation (i.e., from a front face to a rear face of the heat exchanger panel 42). The fasteners 102 are bolts which are received by nuts on an opposite side of the heat exchanger panel 42.

As shown in FIG. 4, the frame 43 also has a lower frame member 54 defining the lower end 46 of the frame 43 and which is identical to the upper frame member 45, namely defining a channel 49 extending laterally. The lower wheel mount 90 also has a removable connector which is similar to the removable connector 94 and is removably connected to the lower frame member 54 of the frame 43. The removable connector of the lower wheel mount 90 does not extend across the entire width of the frame 43, as can be seen in FIG. 4.

As will be understood, the wheel mounts 90 allow the wheels 50, 52 to be selectively removable from the heat exchanger panel 42 simply by removing the fasteners 102 and removing the removable connector 94 from the channel 49. This may facilitate maintenance and/or replacement of the heat exchanger panel 42. Notably, if the heat exchanger panel 42 is defective or otherwise needs replacement, the wheels 50, 52 can be easily removed from the heat exchanger panel 42 and installed on a replacement heat exchanger panel having the same configuration suitable for the removable connector 94 of each wheel mount 90 to be inserted into a corresponding frame member of the frame 43.

Returning to FIGS. 4 and 15, the upper wheel mount 90 also includes two mounting brackets 91, with each mounting bracket 91 interconnecting one of the wheels 50 to the removable connector 94. Each mounting bracket 91 has a first portion 98 extending parallel to the removable connector 94 and a second portion 92 extending perpendicularly to the first portion 98. The corresponding wheel 50 is connected to the second portion 92 such that the axis 51 thereof extends laterally. In particular, as shown in FIG. 15, an axle 100 (which may be a fastener) to which the wheel 50 is mounted extends through the second portion 92 of the mounting bracket 91 and is secured in place by a nut 101. A spring 103 is disposed between the outer surface of the second portion 92 and the wheel 50.

The upper wheel mount 90 also includes a lifting bracket 93 connected to each mounting bracket 91. Each lifting bracket 93 extends perpendicularly from the first portion 98 of the corresponding mounting bracket 91 and defines an opening for connecting a lifting device, such as the hoist system 57, to lift the heat exchanger panel 42 from the lifting bracket 93. A locking member 95 is also provided as part of the upper wheel mount 90 to secure the heat exchanger panel 42 in its final position on the rack structure 14 (via fasteners).

The lower wheel mount 90 is configured in substantially the same manner as the upper wheel mount 90. However, the lower wheel mount 90 does not include the lifting brackets 93 since the heat exchanger panel 42 is intended to be lifted from its upper end.

Although in this embodiment, each wheel mount 90 mounts two of the wheels 50 or 52 to the frame 43 of the heat exchanger panel 42, it is contemplated that, in other embodiments, each wheel mount 90 may mount a single one of the wheels 50 or 52 to the frame 43. For instance, in such embodiments, four wheel mounts 90 may be provided to mount one of the upper wheels 50 or one of the lower wheels 52 to the frame 43. Moreover, it is contemplated that in such embodiments, the removable connector 94 may extend along an end portion of the width of the frame 43.

Other configurations of the wheel mounts 90 are contemplated. For instance, it should be noted that FIGS. 9 and 10 show a different embodiment of the wheel mounts. Notably, alternative wheel mounts 110 are provided having mounting brackets that are shaped differently than those of the wheel mounts 90.

Turning now to FIGS. 6 to 8, a method for mounting one of the heat exchanger panels 42 to the rack structure 14 will be described in greater detail.

As an initial step, the heat exchanger panel 42 is brought to a position behind the rack structure 14. For example, the heat exchanger panel 42 can be brought there by a pallet jack. Notably, due to the ease of mounting provided by the wheeled heat exchanger panel 42 and the rack structure 14 of the present technology, a heavier machine such as a forklift (which occupies more space and is significantly heavier) is not needed to mount the heat exchanger panel 42 to the rack structure 14 as would typically be the case for mounting a conventional heat exchanger panel to a conventional rack structure. Moreover, this affords more space behind the rack structure 14 as space does not have be reserved for allowing the forklift behind the rack structure 14. In addition, a concrete slab which would typically be provided behind the rack structure for a forklift can be foregone.

Once the heat exchanger panel 42 is in position behind the rack structure, in this embodiment, first, in order to lift the heat exchanger panel 42, the lifting brackets 93 of the heat exchanger panel 42 are connected to the hoist system 57 which is mounted to the upper part of the rack structure 14.

With reference to FIG. 6, once the heat exchanger panel 42 is connected to the hoist system 57 via the lifting brackets 93, the heat exchanger panel 42 is lifted via the lifting brackets 93 and held in a generally vertical orientation behind the rack structure 14, on the rear side thereof from which the heat exchanger panel 42 is to be installed.

Next, the heat exchanger panel 42 is lowered until the lower wheels 52 are received and supported by the lower wheel guiding members 70. During this lowering motion, the axis 53 of the lower wheels 52 describes a downward and generally vertical lower wheel path PL. In embodiments in which the upper and lower removable guide extensions 76', 77' are used, prior to lowering the heat exchanger panel 42 onto the lower and upper wheel guiding members, the upper and lower removable guide extensions 76', 77' of the upper and lower wheel guiding members 74', 70' are affixed to the rack structure 14.

With reference to FIG. 7, once the lower wheels 52 are supported by the lower wheel guiding members 70, the heat exchanger panel 42 is rolled downwardly by engagement of the lower wheels 52 with the lower wheel guiding members 70. Since the angled portion 71 of each of the lower wheel guiding members 70 is inclined, lowering the heat exchanger panel 42 causes this rolling of the heat exchanger panel 42 downwardly. With continued reference to FIG. 7, next, the heat exchanger panel 42 is reclined so that the upper end 44 of the frame 43 pivots about the axis 53 of the lower wheels 52. The axis 51 of the upper wheels 50 thus describes an arcuate upper wheel path PU that intersects the lower wheel path PL at a point IN. Notably, as discussed above, this intersection at the point IN between the upper and lower wheel paths PU, PL, whereby the upper wheel path PU extends substantially transversally to the lower wheel path PL, is provided by the difference between the distances D1, D2 which allows the upper and lower wheels 50, 52 to move on different planes from one another when being mounted to the rack structure 14. As mentioned above, this allows keeping the path of the heat exchanger panel 42 as it is being mounted to the rack structure 14 relatively compact such that less space is required to be kept clear behind the rack structure 14. For instance, with reference to FIG. 7, the upper wheel path PU extends, at its rearmost point, at a distance DM from the rearmost vertical leg 20. In this embodiment, the distance DM is approximately 3 meters. This is significantly smaller than is typical for conventional dry cooler stacks where an upper end of the heat exchanger panel would be at distance of 5 meters or more from the corresponding rack structure.

After the heat exchanger panel 42 has been moved forward (i.e., further down on the lower wheel guiding members 70) and reclined backward sufficiently, the upper wheels 50 are supported on the upper wheel guiding members 74. At this stage, if the upper and lower removable guide extensions 76', 77' were used, they can be removed from the upper and lower wheel guiding members 74', 70'.

Next, as shown in FIG. 8, the heat exchanger panel 42 is translated horizontally on the lower and upper wheel guiding members 70, 74 into its final position. As can be seen, in its final position, the heat exchanger panel 42 is in an inclined positioned such that a longitudinal axis LA of the heat exchanger panel 42, extending from the upper end 44 to the lower end 46 of the frame 43, is angled relative to a vertical axis (extending vertically relative to the support surface on which the rack structure 14 is supported). For instance, in this embodiment, in its final position, the longitudinal axis LA extends at an angle of approximately 60° relative to a vertical axis. It is contemplated that the longitudinal axis LA could extend at different angles relative to the vertical axis in other embodiments. Furthermore, as can be seen in FIG. 8, in the final position of the heat exchanger panel 42, the upper wheels 50 and the lower wheels 52 are adjacent to the rearmost and frontmost vertical legs 20 of the rack structure 14 respectively. As such, in the final position, it is the vertical legs 20 that primarily support a load of the heat exchanger panel 42. This can be useful as the lower and upper wheel guiding members 70, 74 do not have to fulfil a load-supporting role and instead just guide the wheels 50, 52, therefore the members of the rack structure 14 to which the lower and upper wheel guiding members 70, 72 are connected do not need to be designed to support the load of the heat exchanger panel 42.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A heat exchanger stack comprising:

a rack structure comprising:

a plurality of vertical legs;

a plurality of laterally-extending horizontal members extending between and interconnecting laterally-adjacent ones of the vertical legs;

a plurality of longitudinally-extending horizontal members extending between and interconnecting longitudinally-adjacent ones of the vertical legs;

a plurality of lower wheel guiding members, each lower wheel guiding member having a horizontal portion extending horizontally and an angled portion that is angled relative to the horizontal portion; and a plurality of upper wheel guiding members vertically spaced from the lower wheel guiding members, each of the upper wheel guiding members extending at least partly horizontally;

and a plurality of heat exchangers supported by the rack structure, the heat exchangers being disposed above one another, each heat exchanger comprising:

a fan assembly mounted to the rack structure, the fan assembly comprising a fan impeller rotatable about a fan rotation axis extending horizontally; and a heat exchanger panel mounted to the rack structure, the heat exchanger panel comprising:

a frame having an upper end and a lower end opposite the upper end;

a tubing arrangement supported by the frame and configured to circulate fluid therein, the tubing arrangement having an inlet and an outlet;

a plurality of fins in thermal contact with the tubing arrangement, the fins being spaced apart from one another for air to flow therebetween and through the heat exchanger panel; and a plurality of wheels mounted to the frame, each of the wheels being rotatable about a respective axis extending generally laterally, the wheels being configured to engage respective ones of the lower and upper wheel guiding members of the rack structure for guided mounting of the heat exchanger panel on the rack structure, the wheels including:

an upper set of wheels mounted to the upper end of the frame, the upper set of wheels including a first upper wheel and a second upper wheel spaced apart from one another; and a lower set of wheels mounted to the lower end of the frame, the lower set of wheels including a first lower wheel and a second lower wheel spaced apart from one another, each upper wheel engaging a corresponding upper wheel guiding member and each lower wheel engaging the horizontal portion of a corresponding lower wheel guiding member so that the heat exchanger panel is translatable horizontally.

2. The heat exchanger stack of claim 1, wherein:

the first upper wheel and the second upper wheel are spaced apart from one another by a first distance;

the first lower wheel and the second lower wheel are spaced apart from one another by a second distance; and the first distance is different from the second distance.

3. The heat exchanger stack of claim 2, wherein the first distance is greater than the second distance.

4. The heat exchanger stack of claim 3, wherein a ratio of the first distance over the second distance is between 1.1 and 1.5.

5. The heat exchanger stack of claim 1, wherein, for each heat exchanger panel:

the frame has a first lateral end and a second lateral end;

the first and second upper wheels are spaced laterally outwardly from the first and second lateral ends of the frame; and the first and second lower wheels are disposed laterally inwardly from the first and second lateral ends of the frame.

6. The heat exchanger stack of claim 1, wherein, for each heat exchanger panel:

the frame comprises:

an upper frame member defining the upper end of the frame, the upper frame member defining a channel extending laterally; and a lower frame member defining the lower end of the frame, the lower frame member defining a channel extending laterally;

and the heat exchanger panel further comprises a plurality of wheel mounts for mounting at least one of the wheels to the frame, each of the wheel mounts comprising:

an elongated rail inserted within the channel defined by one of the upper and lower frame members, the elongated rail being removably connected to the one of the upper and lower frame members; and at least one mounting bracket interconnecting one of the at least one of the wheels to the elongated rail.

7. The heat exchanger stack of claim 6, wherein the elongated rail is connected to the one of the upper and lower frame members by a plurality of fasteners extending from a front face to a rear face of the one of the upper and lower frame members.

8. The heat exchanger stack of claim 6, wherein each of the at least one mounting bracket has a first portion extending parallel to the elongated rail and a second portion extending perpendicularly to the first portion, the one of the at least one of the wheels being connected to the second portion.

9. The heat exchanger stack of claim 6, wherein:

at least one of the wheel mounts comprises at least one lifting bracket;

each of the at least one lifting bracket is connected to a corresponding one of the at least one mounting bracket; and each of the at least one lifting bracket defines an opening for connecting a lifting device to the heat exchanger panel and lifting the heat exchanger panel therefrom.

10. A method for mounting a heat exchanger panel to a rack structure, the method comprising:

lifting the heat exchanger panel via lifting brackets connected to a frame of the heat exchanger panel;

lowering the heat exchanger panel until lower wheels mounted to a lower end of the frame of the heat exchanger panel are received and supported by respective lower wheel guiding members of the rack structure;

rolling the heat exchanger panel downwardly by engagement of the lower wheels with the lower wheel guiding members, a portion of each of the lower wheel guiding members being inclined to guide the lower wheels downwardly;

supporting upper wheels mounted to an upper end of the frame on upper wheel guiding members of the rack structure that are disposed vertically higher than the lower wheel guiding members; and translating the heat exchanger panel horizontally on the lower and upper wheel guiding members into a final position of the heat exchanger panel whereby the heat exchanger panel is in an inclined position such that a longitudinal axis of the heat exchanger panel, extending from the upper end to the lower end of the frame, is angled relative to a vertical axis.

11. The method of claim 10, further comprising, prior to lifting the heat exchanger panel, connecting the lifting brackets to a hoist mounted to an upper part of the rack structure in order to lift the heat exchanger panel via the hoist.

12. The method of claim 10, further comprising:

prior to lowering the heat exchanger panel, affixing upper and lower extension portions of respective ones of the upper and lower guiding members to the rack structure, the upper and lower extension portions extending rearwardly of the rack structure; and after the upper wheels are supported by the rack structure, removing the upper and lower extension portions from the upper and lower guiding members.

13. The method of claim 10, wherein, in the final position of the heat exchanger panel, the upper wheels and the lower wheels are adjacent to vertical legs of the rack structure so that the vertical legs support a load of the heat exchanger panel.

14. The method of claim 10, further comprising:

prior to lifting the heat exchanger panel, removably connecting wheel mounts to the upper and lower ends of the frame of the heat exchanger panel, the wheel mounts interconnecting the wheels to the frame of the heat exchanger panel, said removably connecting comprising:

inserting a rail of each wheel mount into a corresponding one of:

an upper channel defined by an upper frame member of the frame defining the upper end of the frame; and a lower channel defined by a lower frame member of the frame defining the lower end of the frame;

and affixing the rail of each wheel mount to one of the upper frame member and the lower frame member via fasteners extending from a front face to rear face of the one of the upper frame member and the lower frame member.

15. The method of claim 10, wherein:

while lowering the heat exchanger panel, an axis of the lower wheels describes a downward and generally vertical lower wheel path; and the method further comprises:

prior to supporting the upper wheels on the upper wheel guiding members, reclining the heat exchanger panel so that the upper end of the frame of the heat exchanger panel pivots about the axis of the lower wheels, an axis of the upper wheels thereby describing an arcuate wheel path that intersects the lower wheel path.

* * * * *